US011764509B2

(12) United States Patent
Steele et al.

(10) Patent No.: US 11,764,509 B2
(45) Date of Patent: Sep. 19, 2023

(54) SLIDING ELECTRICAL CONNECTOR FOR MULTILATERAL WELL

(71) Applicant: Halliburton Energy Services, Inc., Houston, TX (US)

(72) Inventors: David Joe Steele, Carrollton, TX (US); Justin Mark Roberts, Calgary (CA)

(73) Assignee: Halliburton Energy Services, Inc., Houston, TX (US)

( * ) Notice: Subject to any disclaimer, the term of this patent is extended or adjusted under 35 U.S.C. 154(b) by 135 days.

(21) Appl. No.: 17/535,387

(22) Filed: Nov. 24, 2021

(65) Prior Publication Data

US 2022/0173543 A1 Jun. 2, 2022

Related U.S. Application Data

(60) Provisional application No. 63/118,830, filed on Nov. 27, 2020.

(51) Int. Cl.
*E21B 17/02* (2006.01)
*H01R 13/26* (2006.01)
(Continued)

(52) U.S. Cl.
CPC ..... *H01R 13/26* (2013.01); *E21B 17/028* (2013.01); *E21B 17/0283* (2020.05);
(Continued)

(58) Field of Classification Search
CPC ..... E21B 17/028; E21B 17/0283
See application file for complete search history.

(56) References Cited

U.S. PATENT DOCUMENTS 4,031,969 A * 6/1977 Cullen ..... E21B 17/003 166/66.4
6,776,636 B1 8/2004 Cameron et al.
(Continued)

FOREIGN PATENT DOCUMENTS

CA 2898734 C 8/2020
EP 2414622 B1 11/2017
(Continued)

OTHER PUBLICATIONS

International Search Report and Written Opinion for Application No. PCT/US2021/060855, dated Mar. 24, 2022.
(Continued)

*Primary Examiner* — Giovanna Wright
(74) *Attorney, Agent, or Firm* — Scott Richardson; C. Tumey Law Group PLLC

(57) ABSTRACT

Systems, methods, and apparatus are disclosed allowing relative movement between downhole tools while remaining in electrical communication. In one example, a first tool comprising a first connector body is configured for connecting to a second connector body of a second tool. A sliding connector housing has an electrical strip axially arranged along the connector housing, wherein the first or second connector body is moveably secured to the connector housing in sliding electrical contact with the electrical strip. The first and second connector bodies are releasably connectable to each other, thereby allowing relative movement between the first and second tools via the connector housing while maintaining electrical and fluid communication between the first and second tools.

18 Claims, 6 Drawing Sheets

(51) Int. Cl.
*E21B 23/12* (2006.01)
*E21B 41/00* (2006.01)
*E21B 43/14* (2006.01)

(52) U.S. Cl.
CPC ..... *E21B 23/12* (2020.05); *E21B 41/0042* (2013.01); *E21B 43/14* (2013.01)

(56) References Cited

U.S. PATENT DOCUMENTS

| | | | |
|---|---|---|---|
| 7,228,898 | B2 | 6/2007 | Grigsby et al. |
| 7,510,003 | B2 | 3/2009 | Meijer et al. |
| 7,640,977 | B2 | 1/2010 | Jonas |
| 9,685,890 | B2 | 6/2017 | Tosi et al. |
| 10,050,375 | B1 | 8/2018 | Semple et al. |
| 10,301,888 | B2 | 5/2019 | Richards et al. |
| 10,344,570 | B2 | 7/2019 | Steele |
| 2006/0021799 | A1 | 2/2006 | Hall et al. |
| 2012/0305267 | A1 | 12/2012 | Steele |
| 2013/0118727 | A1 | 5/2013 | Steele et al. |
| 2013/0175047 | A1 | 7/2013 | Steele et al. |
| 2014/0144617 | A1 | 5/2014 | Telfer et al. |
| 2014/0144652 | A1 | 5/2014 | Steele |
| 2015/0060049 | A1 | 3/2015 | Saurer et al. |
| 2015/0060086 | A1 | 3/2015 | Saurer et al. |
| 2015/0083410 | A1 | 3/2015 | Steele |
| 2016/0017689 | A1 | 1/2016 | Steele |
| 2016/0130914 | A1 | 5/2016 | Steele |
| 2016/0153252 | A1 | 6/2016 | Lajesic et al. |
| 2016/0230533 | A1 | 8/2016 | Steele |
| 2016/0251942 | A1 | 9/2016 | Steele et al. |
| 2016/0273312 | A1 | 9/2016 | Steele et al. |
| 2016/0341009 | A1 | 11/2016 | Hussey et al. |
| 2016/0341010 | A1 | 11/2016 | Hepburn et al. |
| 2016/0341011 | A1 | 11/2016 | Steele et al. |
| 2017/0107794 | A1 | 4/2017 | Steele |
| 2017/0130564 | A1 | 5/2017 | Steele et al. |
| 2017/0234113 | A1 | 8/2017 | Steele |
| 2018/0045020 | A1 | 2/2018 | Steele et al. |
| 2018/0283140 | A1 | 10/2018 | Steele |
| 2018/0313156 | A1 | 11/2018 | Steele et al. |
| 2018/0340564 | A1 | 11/2018 | Stokes et al. |
| 2018/0347613 | A1 | 12/2018 | Stokes et al. |
| 2019/0085662 | A1 | 3/2019 | Steele et al. |
| 2019/0120021 | A1 | 4/2019 | Steele |
| 2019/0186222 | A1 | 6/2019 | Steele et al. |
| 2019/0316460 | A1 | 10/2019 | Mannas et al. |
| 2020/0032620 | A1 | 1/2020 | Steele |
| 2020/0080402 | A1 | 3/2020 | Lang et al. |
| 2020/0149370 | A1 | 5/2020 | Steele |
| 2020/0256128 | A1 | 8/2020 | Cho et al. |
| 2020/0270969 | A1 | 8/2020 | Steele et al. |
| 2020/0270970 | A1 | 8/2020 | Hepburn et al. |
| 2021/0010349 | A1 | 1/2021 | Steele |
| 2021/0010350 | A1 | 1/2021 | Steele |
| 2021/0062618 | A1 | 3/2021 | Steele et al. |
| 2021/0140276 | A1 | 5/2021 | Steele et al. |
| 2021/0140278 | A1 | 5/2021 | Steele et al. |
| 2021/0172265 | A1 | 6/2021 | Steele et al. |
| 2021/0172292 | A1 | 6/2021 | Steele et al. |
| 2021/0172293 | A1 | 6/2021 | Steele et al. |
| 2021/0172294 | A1 | 6/2021 | Steele et al. |
| 2021/0172306 | A1 | 6/2021 | Steele et al. |
| 2021/0222520 | A1 | 7/2021 | Steele et al. |
| 2021/0222548 | A1 | 7/2021 | Steele et al. |
| 2021/0230978 | A1 | 7/2021 | Steele et al. |
| 2021/0230980 | A1 | 7/2021 | Steele et al. |
| 2021/0310336 | A1 | 10/2021 | Steele et al. |
| 2021/0372274 | A1 | 12/2021 | Steele et al. |
| 2021/0372276 | A1 | 12/2021 | Steele et al. |

FOREIGN PATENT DOCUMENTS

| | | | |
|---|---|---|---|
| EP | 2591201 | B1 | 10/2019 |
| WO | 2016007165 | A1 | 1/2016 |
| WO | 2018222197 | A1 | 12/2018 |
| WO | 2018222198 | A1 | 12/2018 |
| WO | 2019-125409 | | 6/2019 |

OTHER PUBLICATIONS

Manara production and reservoir management system, Schlumberger, 2020.

Manara system in multilateral wells, Schlumberger. Accessed Feb. 1, 2022. Available at https://www.slb.com/completions/well-completions/intelligent-completions/intelligent-completion-systems/manara-production-and-reservoir-management/multilateral-wells.

Halliburton, FlexRite, Electrical Linear Actuator Concepts, Nov. 24, 2020.

Intelligent Completions, Smartwell intelligent completion systems, Halliburton. Accessed Feb. 1, 2022. Available at https://www.halliburton.com/en/products/smartwell-technology-enhanced-functionality.

Well Completions, Intelligent Completions, DataSphere® LinX® Monitoring System, Halliburton, H012113, May 2021.

VersaFlex_XSL_Expandable_Liner_Hanger_System_SDS_H09713, published Jan. 21, 2021.

* cited by examiner

SLIDING ELECTRICAL CONNECTOR FOR MULTILATERAL WELL

CROSS-REFERENCE TO RELATED APPLICATIONS

The present application is a non-provisional of U.S. Patent Application No. 63/118,830, the entire disclosure of which is incorporated herein by reference.

BACKGROUND

Intelligent well completions systems are used to remotely control and monitor reservoir zones in a well. Generally intelligent well completions systems include valves, as well as other features, configured to provide flow control within the well. Power and communication signals may be provided to the valves from the surface via wiring extending from the surface and through casing and/or other tubulars of the intelligent well completions system. However, connecting the valves and other features to the surface in a multilateral well requires a more complex system that provides connections to a plurality of downhole valves that may be disposed in the main wellbore as well as in wellbore branches extending out from the main wellbore. Unfortunately, traditional systems for splitting the connection from the main wellbore to the wellbore branches may provide unreliable connections, which may hinder efficiency of well production operations.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
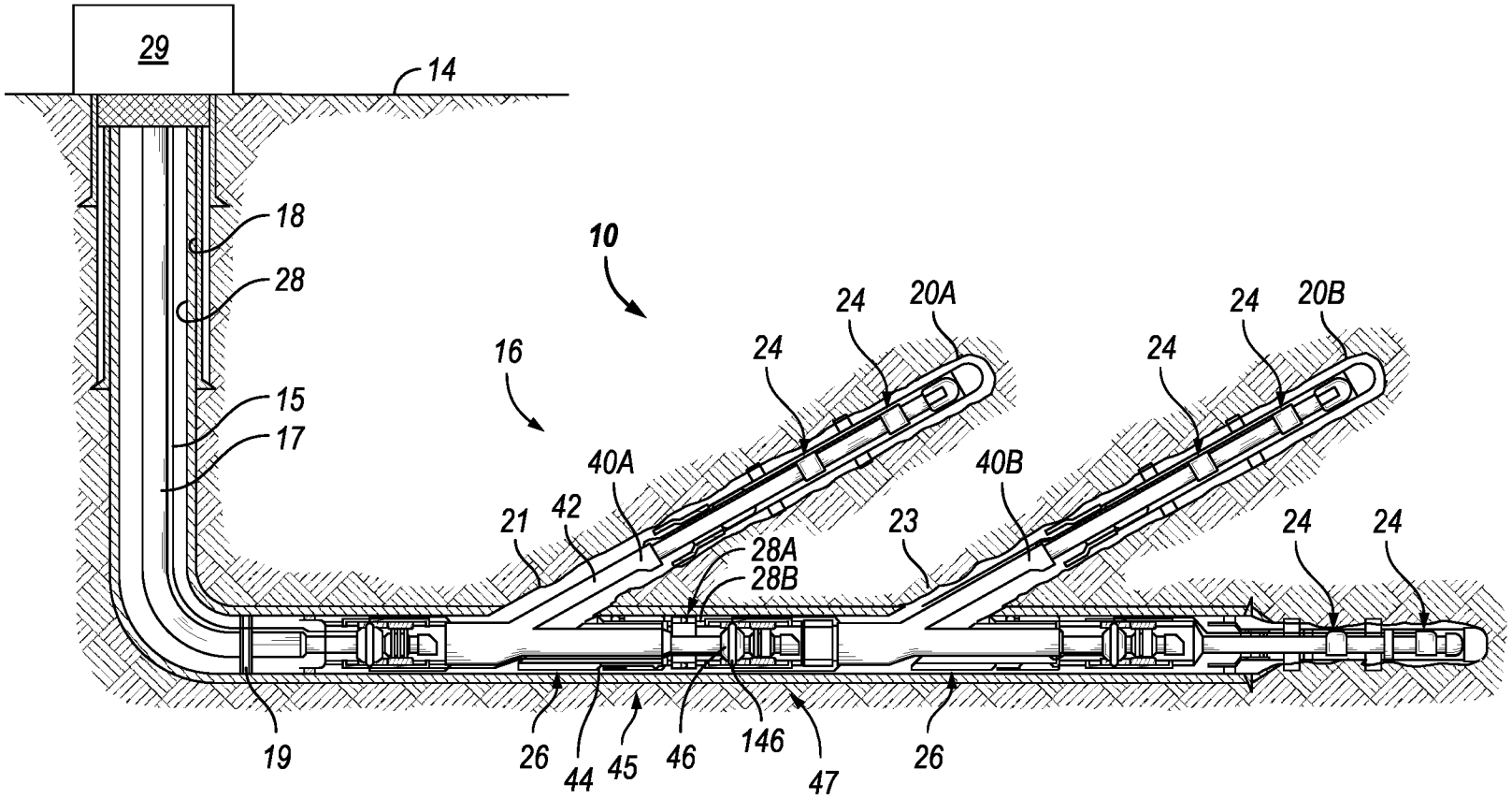
FIG. 1 illustrates a schematic view of a completions system for transferring electrical power and/or communication signals in a multilateral wellbore, in accordance with some embodiments of the present disclosure.

A downhole tool connector, system, and method are disclosed, allowing relative movement between connected downhole tools while staying in electrical contact. The connector may be referred to as a sliding electrical connector in that it allows axial (e.g., linear) relative movement between connector bodies of the respective downhole tools while remaining in electrical and fluid communication. The sliding electrical connector accommodates relative movement between connected tools during operational steps and subsequent lifecycle loads. This may reduce or eliminate stresses between male and female connector bodies or inductive couplers that may otherwise result from relative tool movement downhole.

Systems and methods are also disclosed in which the sliding electrical connector may be used for installing and operating an intelligent completions system to transfer power and communication in a hydrocarbon recovery well. Example embodiments are discussed below in the context of a multilateral well, by way of example. However, the systems and methods can be used in other wells such vertical wells, horizontal wells, or other wells where a downhole connection with relative movement between connector bodies is desired. The system may also be used in systems with more than two completion systems (e.g., a third, middle string). Aspects may be used with electrical submersible pumps, ("ESP") technologies, etc. ESP is an efficient and reliable artificial-lift method for lifting moderate to high volumes of fluids from wellbores. These volumes range from a low of 150 B/D to as much as 150,000 B/D (24 to 24,600 $m^3$/d). Variable-speed controllers can extend this range significantly, both on the high and low side. The electricity carried through the disclosed connectors can be used to provide power to other systems such as a down-hole hydraulic system, and fiber-optical system, sonic, gamma, radio frequency (RF), etc.

An example system includes a multilateral junction, optionally using inductive couplers within the sliding electrical connector to connect to other downhole tools. The connections made at the multilateral junction may allow for electrical power and data transmission from the surface to downhole portions of a multilateral well, including the main wellbore and to wellbore branches. This connection and method may facilitate the downhole coupling and de-coupling of two devices, such as between a junction leg of the disclosed multilateral junction with the bore of a downhole completions assembly that receives the junction leg.

A disclosed system embodiment may provide continuous electrical contact between two or more downhole tools or components even while there is relative movement between the tools/components. In one or A disclosed method embodiment allows for engaging two or more downhole tools/components mechanically, electrically and/or hydraulically. The engagement may happen during the same trip or even if/when the tools/components are run into the well on separate trips. The connected tools may move relative to one another while maintaining electrical communication (power, data, etc.). The method may also allow the tools to remain hydraulically connected, e.g., to allow hydrocarbons to flow between the tools without losing fluid or encounter a pressure drop.

The electrical connections may be used to provide power, data, controller functionality, logic, computational transmission, etc. to one local within a well to another local (including the surface). The electrical connections may be used to provide sensed data about the connector itself (e.g., position, oil temperature, forces, pressures, etc.) The connector may incorporate resistance (e.g., springs or other biasing mechanism), controlled resistance (e.g., a damper such as a hydraulic-controlled cylinder, etc.) to control the rate-of-movement and forces during engagement of systems, operation of system(s), e.g., control shocks/vibration due to natural events such as gas breaking out of oil violently, human-intervention operations, stimulations, cool-down issues, etc. Other features may be used to monitor the well's parameters, equipment's parameters, natural-occurring variables, and other parameters.

FIG. 1 illustrates a schematic view of a completions system 10 for transferring electrical power and communication signals in a multilateral well 16, as an example of a downhole system in which embodiments of the present disclosure may be implemented. The multilateral well 16 is formed below a surface 14 of a well site 12. The surface 14 may represent ground level of a land-based well site or the sea floor of a subsea or offshore well site, for example. Various surface equipment 29 may be located at or above the surface 14 for supporting drilling and completion of the multilateral well 16. The surface equipment may include, for example, a rig for supporting downhole equipment as it is lowered into the well 16, fluid systems for circulating fluid to and from surface 14, and electrical equipment for communicating power and data with downhole equipment. The completions system 10 may comprise a category generally referred to as intelligent completions, wherein electronic controls are implemented to monitor and control production of hydrocarbons. Thus, reliable and robust electrical equipment and connections are desired, as provided by aspects of this disclosure.

The multilateral well 16 includes a main bore 18 which may include a vertical portion extending from surface 14 and which transitions to a horizontal portion further below the surface 14. At least a portion of the main bore 18 may be lined with a string of casing 28. Components of the casing 28 may include a liner hanger 28A and liner 28B. The multilateral well 16 includes any number of lateral wellbores (i.e., laterals) 20 that intersect the main bore 18, and in this example includes first and second laterals 20A, 20B. Laterals may be formed in any suitable manner, such as using some version of a whipstock assembly or its equivalent. A production packer 19 seals the well 16 above where the completions system 10 or lower components thereof are installed. The production packer 19 may seal an annulus between a tubular string 17 which may include upper components (not shown) of the completions system 10. An upper umbilical 15 extends along the tubular string 17 to surface, providing an electrical communication pathway for power and data between the surface 14 and lower components of the completions system 10.

The lower components of the completions system 10 may include any number of multilateral junctions for reinforcing the well 16 at the intersections with the main bore 18 and laterals 20. In the illustrated embodiment, the completions system includes an upper multilateral junction 40A at an intersection between the main bore 18 and the upper lateral 20A and a lower multilateral junction 40B at an intersection between the main bore 18 and the lower lateral 20B. The upper multilateral junction 40A includes a first leg (i.e., lateral leg) 42 disposed in the upper lateral 20A and a second leg (i.e., main bore leg) 44 disposed in the main wellbore 18. Similarly, the lower multilateral junction 40B includes a lateral leg 42 disposed in the lower lateral 20B and a main bore leg 44 disposed in the main wellbore 18. The two multilateral junctions 40A, 40B may be discussed generally to refer to similar features, but the multilateral junctions are not required to be identical.

The completions system 10 of FIG. 1 is an example of a well system in which there are multiple well tools to be connected to establish electrical and fluid communication between different parts of the completions system 10. For example, the multilateral well 16 may require such a connection to be made where a well tool is tripped downhole to land in one of the legs 42, 44 of one of the multilateral junctions 40. Such connections may also be required between each leg 42, 44 of a multilateral junction with the respective lateral or main bore portion downhole of the legs 42, 44. Each connection may be required to provide both fluid and electrical communication across the connection between any two points in the multilateral well 16 on either side of the connection. A sliding electrical connector as further described below may be configured for use at any of these connections.

As illustrated, a plurality of control and sensor devices 24 may be disposed within each lateral 20A, 20B as part of the completions system 10. The control and sensor devices 24 may include or be operatively connected with controllable production valves, for example, to selectively control production flow from different laterals or from different portions of each lateral 20. The upper multilateral junction 40A may provide electrical pathways to couple wiring (e.g., the upper umbilical 15) to corresponding wiring of the lateral leg 42 (e.g., upper lateral umbilical 21) to provide electrical power and/or communication signals to the plurality of control and sensor devices 24 in the upper lateral 20A. Likewise, the lower multilateral junction 40B may provide electrical pathways to couple wiring (e.g., the upper umbilical 15 or upper lateral umbilical 21) to corresponding wiring of the lateral leg 42 (e.g., lower lateral umbilical 23) to provide electrical power and/or communication signals to the plurality of control and sensor devices 24 in the lower lateral 20B. In at least some embodiments, the electrical power and communication signals may be sent from the surface 14 via the wiring to control operation of one or more downhole tools, such as downhole valves. Communication signals may also be sent from sensors or other devices, via the wiring, to the surface. As such, the wiring connection may allow the surface to remotely control devices and monitor reservoir zones via one or more well tool connections at the multilateral junctions 40.

The completions system 10 also includes a multilateral completion deflector 26 at each multilateral junction 40. In the illustrated embodiment, the deflector 26 at the upper junction 40A may be referred to as an upper multilateral completion deflector and the deflector 26 at the lower junction 40B may be referred to as a lower completion deflector. Each multilateral completion deflector 26 may be disposed directly downhole from a corresponding lateral 20 to deflect tools of the completions system out into the corresponding lateral 20. For example, each deflector 26 may be configured to deflect a lateral leg 42 of the respective multilateral junction 40. In at least some embodiments, each deflector 26 may provide a no-go location for the respective multilateral junction 40. The deflector 26 may have a large enough inner diameter (ID) for receiving a main bore leg 44 of the multilateral junction 40, so as to guide the main bore leg 44 of the multilateral junction 40 into its bore. The multilateral completion deflector may include features that reduce or eliminate bending stresses on the multilateral junction components. The multilateral completion deflector bore may be configured to restrict the flow area when the main bore leg of the multilateral junction enters with the intent to create a pressure increase that can be seen from surface.

When the multilateral junction 40 is landed or latched into the multilateral completion deflector or an assembly that includes the multilateral completion deflector, a hydraulic seal is formed in which the geological formation around the one or more casing junctions is hydraulically isolated from the internal bore of the multilateral junction and/or other casing junction(s). An alternative way to deflect the end of the pipe/string connected to the multilateral junction lateral leg into the lateral wellbore is to use a bent, articulating, sensor or weighted joint connected on the end of the pipe/string on end of lateral leg of the multilateral junction.

Any two downhole components where one is connected to the other according to this disclosure may be considered downhole tools so connected. In the context of FIG. 1, just by way of example, when the main bore leg 44 of the respective multilateral junction 40 is lowered into the main bore 18 and lands in the multilateral completion deflector 26, the main bore leg 44, extends through the completion deflector 26 to connect with another component 47, attached below the liner hanger. In an alternative configuration of FIG. 1, the connection 45 could alternatively be formed between the main bore leg 44 (as one well tool) and the completion deflector 26 (as another well tool), but such other configuration may require another energy transfer device between the completion deflector and the lower completion. The connection 45 may comprise an electrical, mechanical, and fluid connection. The electrical connection permits the transmission of electrical power and/or signals across the connection. The fluid connection permits the flow of fluids across the connection, such as produced hydrocarbons (subject to valves and other flow controls). The mechanical connection may be a releasable connection that physically holds the devices together, to thereby maintain the electrical and fluid connection, until the connection is released. In some embodiments, the mechanical connection allows relative movement between the main bore leg 44 and the well tool to which it is connected (e.g., the deflector 26 or other equipment below the liner hanger) while maintaining the electrical and fluid connections, as further described below and shown in subsequent figures.

The electrical connection may be made in a number of ways, either through direct or indirect electrical contact or contactless (e.g., inductive) electrical communication between corresponding connector bodies. In some cases, the electrical connection comprises an energy transfer mechanism (ETM) 46 on the multilateral junction with a corresponding ETM 146 on or connected to an anchoring device of the multilateral completion deflector 26. Each ETM 46 can transfer electrical power and data communication to other ancillary devices to which it is connected in an adjoining lateral wellbore and/or main wellbore, such as via an electrical conduit or wirelessly, and said ancillary devices can transfer communication back to the respective ETM 46. The ETMs 46 may communicate with each other across the connection 45. Thus, power and communication may be transferred from surface 14 to the uppermost ETM in the well and said ETM can transfer communication back to surface 14.

In some configurations, the ETM may rely on physical (director or indirect) electrical contact between components of the mating connector bodies, including corresponding first and second electrical contacts that are positioned for contact when one connector body is releasably secured to the other connector body. In other configurations, an ETM may be a wireless energy transfer mechanism (WETM) including an inductive coupler for electrically coupling the first and second connector bodies without direct electrical contact with each other when the connector bodies are releasably secured.

The system may include use of one or more system Test Tools for monitoring Inductive Couplers, systems, methods, etc. The system may include one or more of Linear Slip Rings to assist with aligning the lower multilateral junction to the anchoring device required for the upper multilateral completion deflector. The device or method to transfer power or communications to a lower lateral wellbore may or may not be reliant on the device or method to transfer power or communications to an upper lateral wellbore. The method of which the anchoring devices for the multilateral junction are conveyed, allows for frequent and intermittent axial orientation checks via a pressure pulse device such as measurement while drilling (MWD) tool, a work string orientation tool (WOT), etc. Moreover, the system may include use of an isolation device between the lateral wellbores that can be opened and closed repeatedly.

Figure 2:
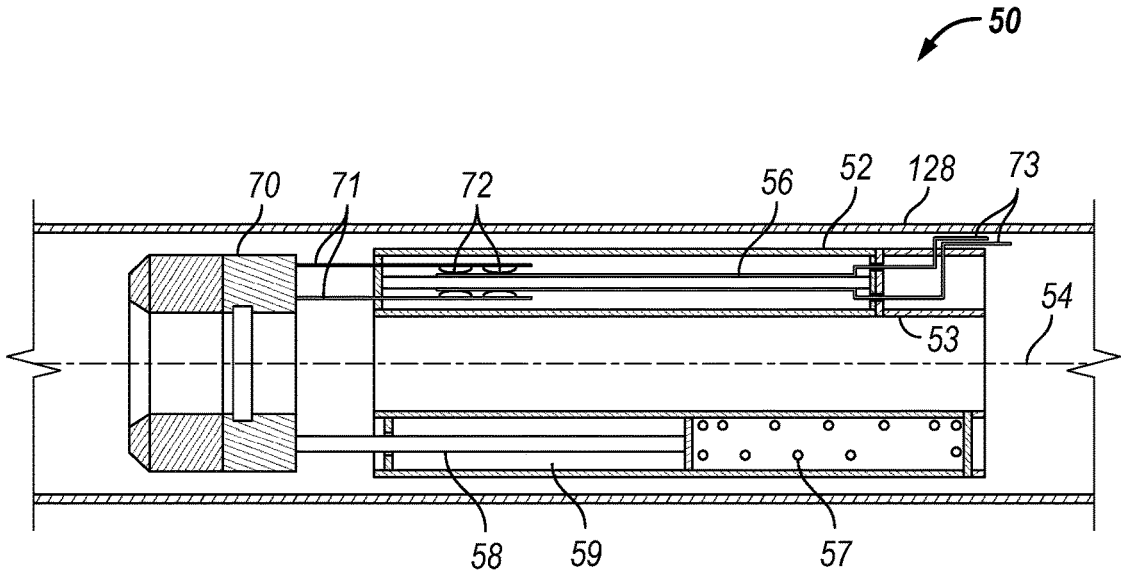
FIG. 2 is a schematic diagram of a sliding electrical connector that allows for relative movement between connected downhole tools while maintaining electrical and fluid communication therebetween.

FIG. 2 is a schematic diagram of a sliding electrical connector 50 that allows for relative movement between connected downhole tools while maintaining electrical and fluid communication therebetween. As a schematic, the drawing is not to scale, is not limited to the geometry as drawn, and multiple embodiments may be constructed consistent with the schematic including various combinations of the described elements and features. A connector housing may be described as a sliding connector housing in that it is moveably secured to a connector body to allow relative (e.g., sliding) movement between the connector body and connector housing. In this embodiment, a sliding connector housing 52 defines an axis 54 and an axially extending interior fluid flow path 53 therethrough. The sliding connector housing 52 may be disposed in a downhole tubular 128. The sliding connector housing 52 in this example is preferably mounted in the liner 28B positioned between the liner hanger 28A and the junction of FIG. 1.

A first (female in this example) connector body 70 is moveably secured to the connector housing 52, such as by being secured to an elongate guide member referred to in embodiments below as a traveling support member 58 in a direct or indirect sliding relationship with respect to the sliding connector housing 52. The travelling support member 58 is optionally disposed in an annular chamber 59 of the housing 52. A damper fluid or other damping member may be disposed in one portion of the annular chamber 59 to dampen an axial displacement between the first connector body and the sliding connector housing. A spring 57 or other biasing mechanism may be operatively coupled to the sliding connector housing 52 for biasing the connector body 70 to a neutral position with respect to the sliding connector housing 52. The neutral position may be somewhere along the range of axial movement between the connector body 70 and sliding connector housing 52, so that the connector body 70 has freedom to move axially in either direction. In this example, the spring is optionally disposed in another portion of the annular chamber 59 opposite the damping fluid. Thus, the sliding electrical connector 50 allows for relative movement between the first connector body 70 and the sliding connector housing 52, which relative movement may be dampened and/or biased.

In some embodiments, the fluid in the chamber 59 may be hydraulically controlled to provide controlled resistance or actuation. Beyond using the fluid as a damper, the hydraulic control functionality may be used, for instance, to control a rate of damping. The rate of damping may be used to control the rate-of-movement and forces during connection of tools, such as during engagement of systems of an intelligent completions system.

The sliding electrical connector 50 also allows for relative movement between the first connector body 70 and the sliding connector housing 52 while maintaining electrical contact. An electrically conductive strip (i.e., electrical strip) 56 is axially arranged along the sliding connector housing 52. The electrical strip 56 may be disposed directly on the sliding connector housing 52 or on some intermediate component coupled to the housing 52, such as along the traveling support member 58 optionally disposed in the sliding connector housing 52. The electrical strip 56 is shown as a relatively narrow strip at a circumferential position, but may take any of a variety of forms and not limited to the form as drawn. By way of example and not by limitation, the strip may alternatively be an annular sleeve with all or just a linear portion exposed for contact. The strip 56 is continuous as shown but could alternatively comprise discrete segments axially arranged. The segments could be abutting to provide substantially continuous electrical contact, or slightly axially spaced to provide many axially and/or radially spaced points of contact to provide multiple redundant electrical contacts.

One or more conductor wires 71, e.g., a positive and negative wire, are used to couple the connector body 70 to respective electrical contacts 72 thereby forming part of a conductive path from the connector body 70 to the electrical strip 56. There may be multiple (e.g., redundant or contingency) contacts 72 in contact with each wire 71. The conductive strip 56 may be exposed along its length to the contacts 72, so one or more of the contacts 72 remain in sliding electrical contact with the electrical strip 56 over a range of axial displacement between the first connector body 70 and the sliding connector housing 52. Thus, an electrical path may be maintained from the connector body 70, along the wires 71, through the sliding contacts 72 to the electrical strip 56, along the electrical strip 56 on the sliding connector housing 52 to the other wires 73 allowing relative movement of the first connector body 70 to the sliding connector housing 52.

The traveling support member 58 therefore provides a number of technical advantages, including the ability to allow relative movement between the two connector bodies, and accordingly, the two downhole tools connected thereby. Moreover, in a preferred embodiment, the traveling support member 58 primarily only has to support axial loads. The traveling support member 58, itself, may not have to retain a pressure barrier or restrain the flow of fluids. Those features may instead be provided by the seal assembly mounted below the electrical actuator. Also, electrical conductors like wires 71 are not required to vary in length (i.e., no flexure is required) to accommodate the relative movement between connector bodies. For example, wire 71 does not need to be coiled or include excess length or bends to accommodate movement. Rather, the sliding electrical contact may instead allow this relative movement between connector bodies.

Figure 3:
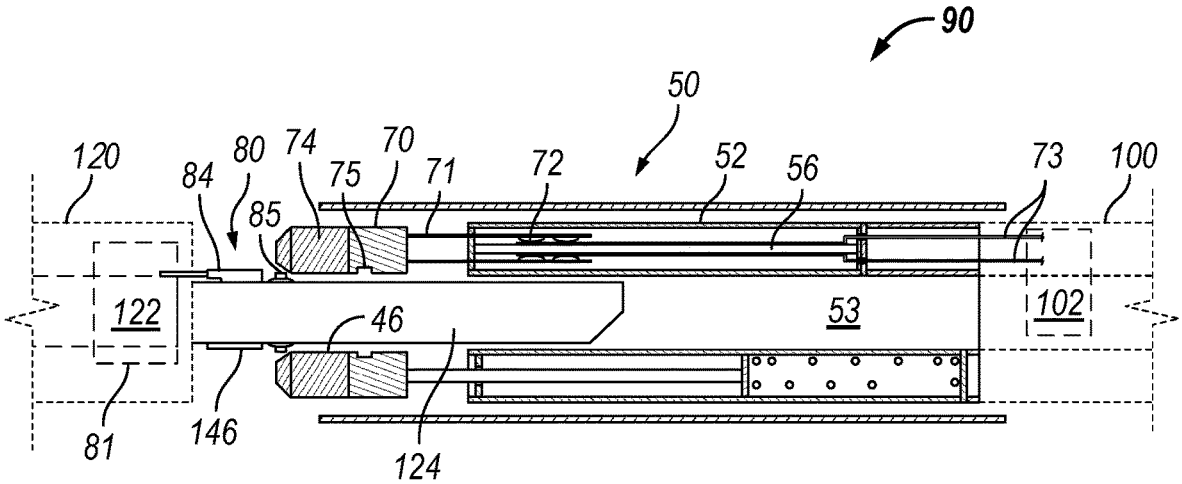
FIG. 3 is a schematic diagram of a well system including a first downhole tool for connection with a second downhole tool using the sliding electrical connector of FIG. 2.

FIG. 3 is a schematic diagram of a well system 90 including a first downhole tool 100 for connection with a second downhole tool 120 using the sliding electrical connector 50 of FIG. 2. The first and second tools 100, 120 may be any of a variety of tools usable in a well, and are schematically shown to cover a wide range of tool configurations. The tools 100, 120 may be components of the completions system 10 of FIG. 1, in some examples. The terms "first" and "second" are used to refer individually to the respective tools 100, 120, and the terms are not intended to be limiting such as in terms of a particular order or arrangement. The first tool 100 is downhole of (further down the wellbore) than the second tool 120 in this example, although other arrangements are possible. In some applications, the tools 100, 120 may be brought into connection downhole, and in other applications, they may be connected at surface and then lowered into a well together. In this example, the first tool 120 may be secured and/or sealed within the outer tubular 128, which may be some structure fixed with respect to a wellbore, such as a casing or a liner, or an outer tool housing or other tubular member secured downhole. Securing the first tool 100 downhole may facilitate connecting the second tool 120 to the first tool 100 downhole.

The first connector body 70 is coupled to the first tool via the sliding connector housing 52. Wires 73 on the sliding connector housing 52 may be coupled to electrical data and/or power transmission components 102 of the first tool 100. These electrical data and/or power transmission components 102 may be in communication with a downhole electrical system, such as an intelligent completions installation. A second (male in this example) connector body 80 is rigidly secured to a body of the second tool 120 and is configured for releasably connecting to the first connector body 70. Wires 81 leading from the second connector body 80 may be coupled to electrical data and/or power transmission components 122 of the second tool 120. The first and second connector bodies 70, 80 are configured for releasably connecting to one another (mechanically, electrically, and fluidically), and the two connector bodies 70, 80 may be referred to as a connector pair.

The first and second connector bodies are aligned for connection in FIG. 3, with a tubular member 124 of the second tool 120 having entered the flow bore 53 of the first tool 100. The first connector body 70 is male and the second connector body 80 is female in this example, although the reverse could be true. A mechanical connection between the connector bodies 70, 80 may be established using, for example, keys, dogs, collets, or other releasable connection type as represented by corresponding connector profiles 75, 85. Physically connecting the connector bodies 70, 80 establishes a fluid connection for communication of well fluids along an internal flow path collectively defined by the tools 100, 120 and other components of the sliding electrical connector 50. Physically connecting the connector bodies 70, 80 also establishes an electrical connection between the first and second tools 100, 120 for data and/or power communication. The sliding connection provided by the sliding electrical connector 50 allows relative movement between the tools 100, 120 via the sliding connector housing 52 while maintaining electrical and fluid communication.

The electrical connection at the connector pair 70, 80 may be made in a number of ways. In some configurations, the electrical connection may be established between an ETM 46 on the first tool 100 and a corresponding ETM 146 on the second tool 120 when the connector bodies 70, 80 are mechanically connected. In other configurations, the ETMs may be wireless energy transfer mechanisms (WETMs) including an inductive coupler for electrically coupling the first and second connector bodies 70, 80.

Figure 4:
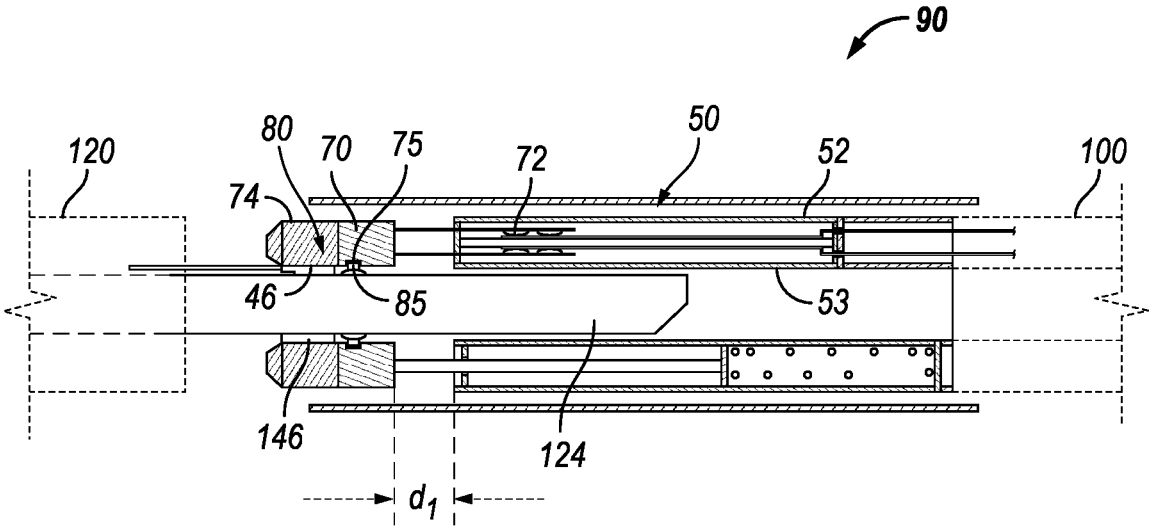
FIG. 4 is a schematic diagram of the well system of FIG. 3 wherein the well tools have been connected at their respective connector bodies.

FIG. 4 is a schematic diagram of the well system 90 of FIG. 3 wherein the well tools 100, 120 have been connected at their respective connector bodies 70, 80. For example, the second downhole tool 120 may be lowered from its position in FIG. 3 until the mating connector profiles 75, 85 have been locked into engagement. Electrical communication is established between the connector bodies 70, 80, such as using the ETMs 46, 146. The tools 100, 120 are also fluidically coupled by insertion of the tubular member 124 from the second tool 120 into the interior flow path 53 in the sliding connector housing 52 that is connected to the first tool 50. Relative movement between the sliding connector housing 52 and the first connector body 70 will allow for relative movement between the tools 100, 120, while the sliding electrical connector 50 maintains both electrical and fluid communication between the tools 100, 120. In FIG. 4, the first connector body 70 is at an axial displacement "d1" with respect to the sliding connector housing 52. This or another position may be a neutral position to which the first connector body 70 is biased relative to the sliding connector housing 52.

Figure 5:
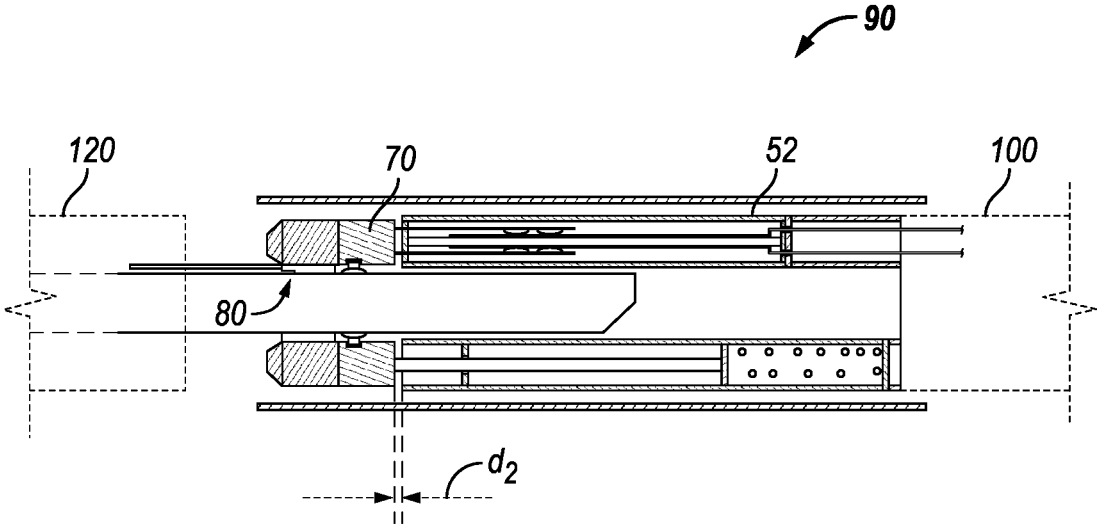
FIG. 5 is a schematic diagram of the well system, wherein the connected well tools have been moved closer together with respect to their position in FIG. 4 via the sliding electrical connector.

FIG. 5 is a schematic diagram of the well system 90, wherein the connected well tools 100, 120 have been moved closer together with respect to their position in FIG. 4 via the sliding electrical connector 50. The connector body 70 has shifted closer to the sliding connector housing 52 from axial displacement d1 of FIG. 4 to a new axial displacement "d2." The two connector bodies 70, 80 are releasably connected mechanically, so the connector bodies 70, 80 move together and their relative position to each other does not change. The second connector body 80 now moves together with the first connector body 70 as the connector body 70 moves relative to the sliding connector housing 52, to allow the connected tools 100, 120 to be moved toward or away from each other, while remaining in electrical and fluid communication.

Figure 6:
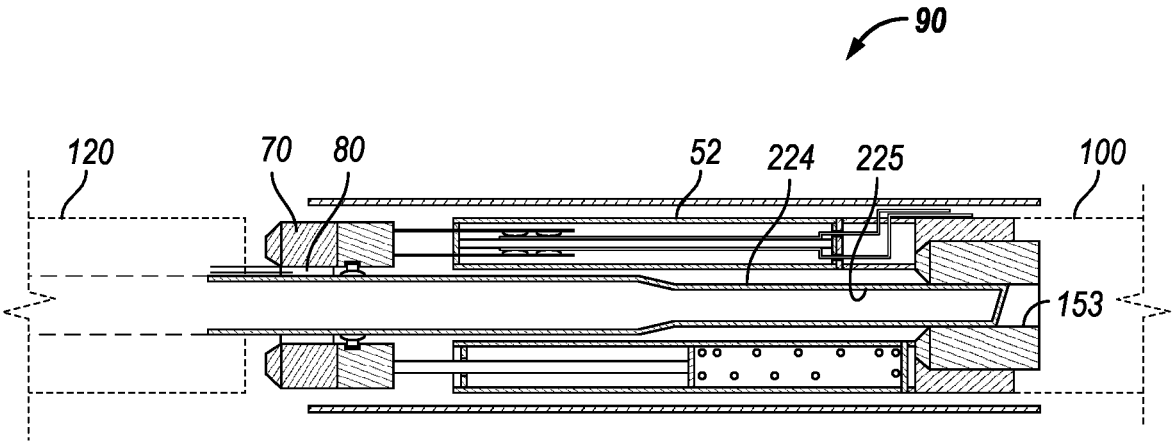
FIG. 6 is a schematic diagram of another well system in which a male tubular end of one tool is sealingly engaged in a polished bore receptacle.

FIG. 6 is a schematic diagram of another well system configuration 190 with another example tool configuration. In this example, one tool (e.g., the second tool 120) has a male tubular end 224 that is sealingly engaged in a polished bore receptacle (PBR) 153 of another tool (e.g., first tool 100). The PBR 153 may be defined by the sliding connector housing 52 or the first tool 100, for example. At least a portion of a sealed fluid communication pathway is thereby formed from a flow bore 225 of the male tubular end 224 on the second tool 120 to the PBR 153 of the first tool 100. As in the prior embodiment, the corresponding connector bodies 70, 80 are physically coupled via connector profiles 75, 85 (keys, dogs, collets, etc.) and electrically coupled with one or more ETM, WETM, or electrical contacts, placing the tools 100, 120 in sliding electrical and fluid communication.

Figure 7:
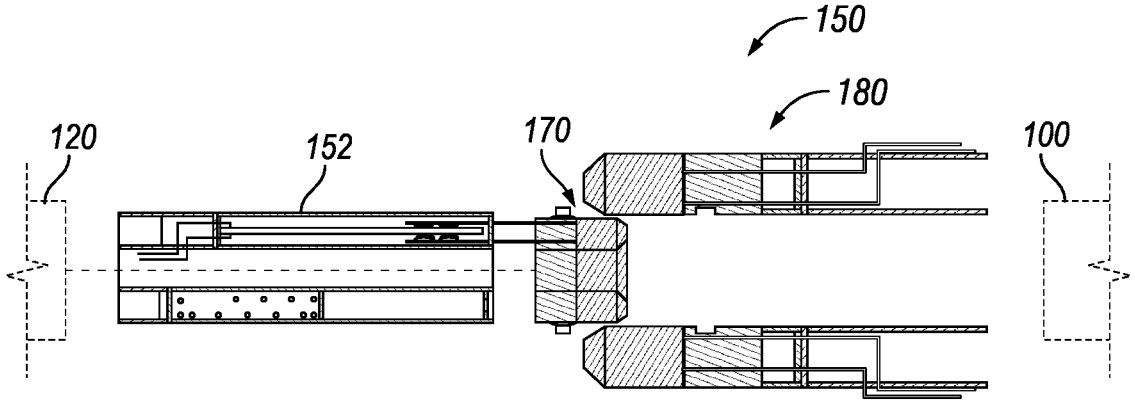
FIG. 7 is an alternative embodiment of a sliding electrical connector, wherein a sliding connector housing is secured to a male connector body.

FIG. 7 is an alternative embodiment of a sliding electrical connector 150, wherein a sliding connector housing 152 is secured to a male connector body 170. The male connector body 170 may be uphole of a female connector body 180 in this example, such as if the second tool 120 is to be lowered into connection with the first tool 100. The sliding connector housing 152 may be wired to the second tool 120 and the male connector body 170 to allow relative movement between the male connector body 170 and sliding connector housing 152. The female connector body 180 may be rigidly secured, and wired to, the first tool 100. The two connector bodies 170, 180 may be releasably connected such as discussed in the foregoing example, thereby allowing relative movement between the first and second tools 100, 120 via the sliding connector housing 152 while maintaining electrical communication between the first and second tools 100, 120. In the illustrated embodiment, the sliding electrical connector includes a male ETM, WETM, and/or inductive coupler configured to enter a corresponding female ETM, WETM, and/or inductive coupler.

Figure 8:
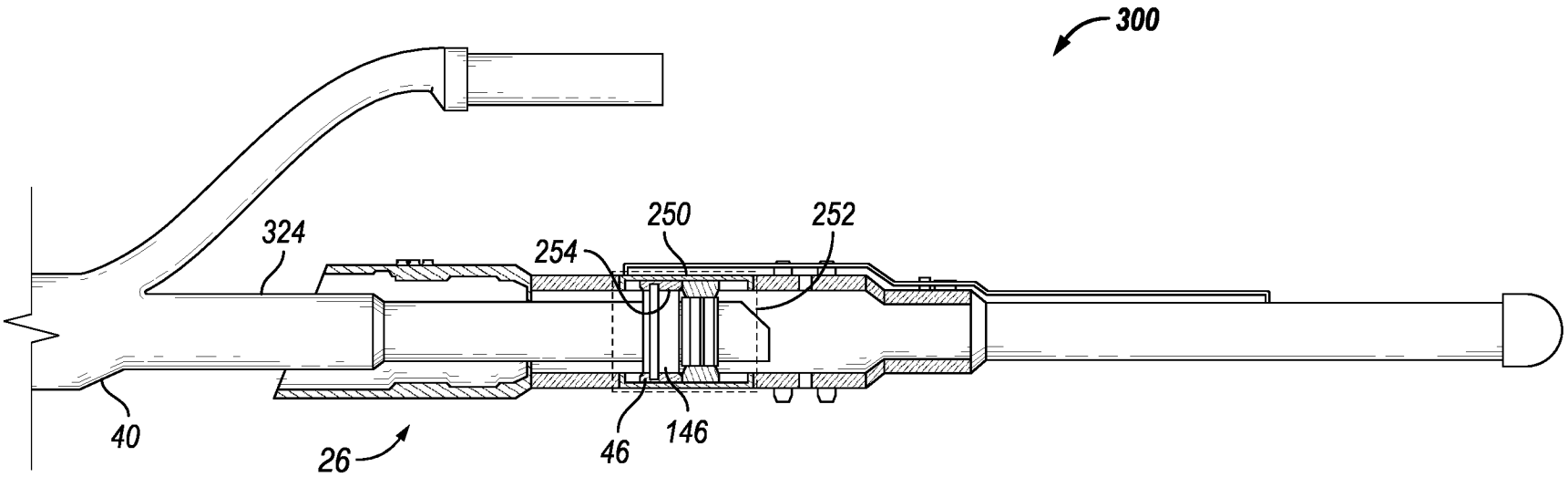
FIG. 8 is a well system with a female sliding electrical connector receiving a mainbore leg of a multilateral junction.

FIG. 8 is a portion of a well system 300 illustrating the use of another example configuration of a female sliding connector 250. The sliding connector 250 of FIG. 8 may, at minimum, be configured for mechanically coupling two wellbore tools or components to allow relative movement between the tools or components. In this example, a deflector assembly 26 is illustrated as receiving a mainbore leg 324 of a multilateral junction to connect the multilateral junction with the deflector assembly 26. The deflector assembly 26 may comprise an anchor, an anchor-packer, a seal bore, seals, an ETM 46, a female inductive coupler, a sensor, an energy storage device, a spring, a seal protector device, a collet, a no-go shoulder, a travel joint, a slidable sleeve, a slip joint, a computer, a valve, a meter, control line, a seal assembly, a wet-mate connector, a whipstock, a removable whipstock face, a removable deflector, a pump, screen, a liner, and/or other components used in the production of oil and gas, etc.). The second downhole tool 120 or components thereof (e.g. multilateral junction 40) may have other devices attached to it including, but not limited to, a seal assembly, a locking device, an ETM 46, a male WETM, a male inductive coupler, a male portion of a downhole wet-mate connector, a sensor, an energy storage device, a spring, a seal protector device, a collet, a no-go shoulder, a travel joint, a slidable sleeve, a slip joint and/or other components used in the production of oil and gas, etc. In some embodiments, these devices may be positioned on the distal end of a mainbore leg 324. In some embodiments, these devices may be positioned below 46 as shown in FIG. 1. In other embodiments, these devices may be positioned above and/or below the ETM 46. In some embodiments, these devices may be positioned below and/or above male connector body 170 of FIG. 7. In some embodiments, these devices may be positioned below and/or above the sliding electrical connector 150 of FIG. 7. In this and other examples, electrical communication is not always required across the sliding connector 250 of FIG. 8. The sliding connector 250 may comprise a travel joint 252 with an inner sleeve 254 that slides relative to a tool body of the deflector assembly 26, and which includes a mechanical connector (e.g., collet connector, latch, radially moveable dogs, etc.) for coupling the inner sleeve 254 to the mainbore leg 324 of the multilateral junction to allow relative movement between the mainbore leg 324 and the deflector assembly 26.

If electrical connection is also desired, electrical couplers such as ETMs 46, 146 may be incorporated into the sliding connector 250. To maintain electrical communication, the sliding connector 250 may be provided with slack or excess wiring (e.g., a coil) to accommodate relative movement. Alternatively, a sliding electrical contact (not explicitly shown in FIG. 8) and other features, such as generally described in any of the foregoing embodiments. The female sliding connector 250 may be constructed according to aspects of the schematic of FIG. 2, for example, for receiving a corresponding male electrical connector. The sliding electrical connector 250 may be configured as described above to ensure male and female inductive couplers included with ETMs 46, 146 move together as a unit and maintain their alignment during operation and subsequent lifecycle loading. An inner and an outer sleeve of the sliding electrical connector (and/or other device such as a travel joint) are free to move with respect to each other once activated. Further, the sliding electrical connector (and/or other device such as a travel joint) accommodates for any movement during operational steps (e.g., pressure test) and subsequent lifecycle loads (e.g., heating/cooling and pressure drawdown) without moving the position of the male and female inductive couplers with respect to each other since they are anchored together. Moreover, the sliding connector reduces or eliminates stresses on the male and female inductive couplers due to any movement caused factors mentioned above.

In one or more embodiments, a sliding electrical connector may include pure niobium, such that the sliding electrical connector can be mated and de-mated while fully exposed to seawater. When the niobium is in contact with water, it reacts to create a film that acts as an insulator and prevents electricity from flowing through the water surrounding the contacts. As such, the sliding electrical connector may include insulation formed via water surround the sliding electrical connector to prevent corrosion and short circuiting. Moreover, any suitable materials, types of slips rings, other devices, computers, algorithms, logic devices, fail-safe devices, dielectric materials, insulative material, conducting materials, and combinations thereof, may be used in the sliding electrical connector. For example, the sliding electrical connector may include oil filled and pressure balanced socket contact, redundant O-rings, seals, bladders, bladder closures, with a suitable material (e.g., titanium, 17-4 PH, Nitronic 50, Inconel, PEEK, nitrile, elastomeric, plastic, metal, liquid, gas, solid, etc.).

In one or more embodiments, a sliding electrical connector may include a brush-raising device. For example, if a non-normal event is detected, the set of brushes (contacts) may be "raised" (opened), via the brush raising device, to shut off one or more power/communication supplies/sources for a predetermined time or when another event occurs to signal the contacts should close again. Additionally, or alternatively, the sliding electrical connector may include a brush-lowering/contact-lowering/contact-engaging/contact-making device. For example, if a primary set of brushes (contacts) fail (or begin to fail), a sensor or mechanism may sense the change in power an activate the secondary (backup) brushes (contacts) to engage.

Figure 9:
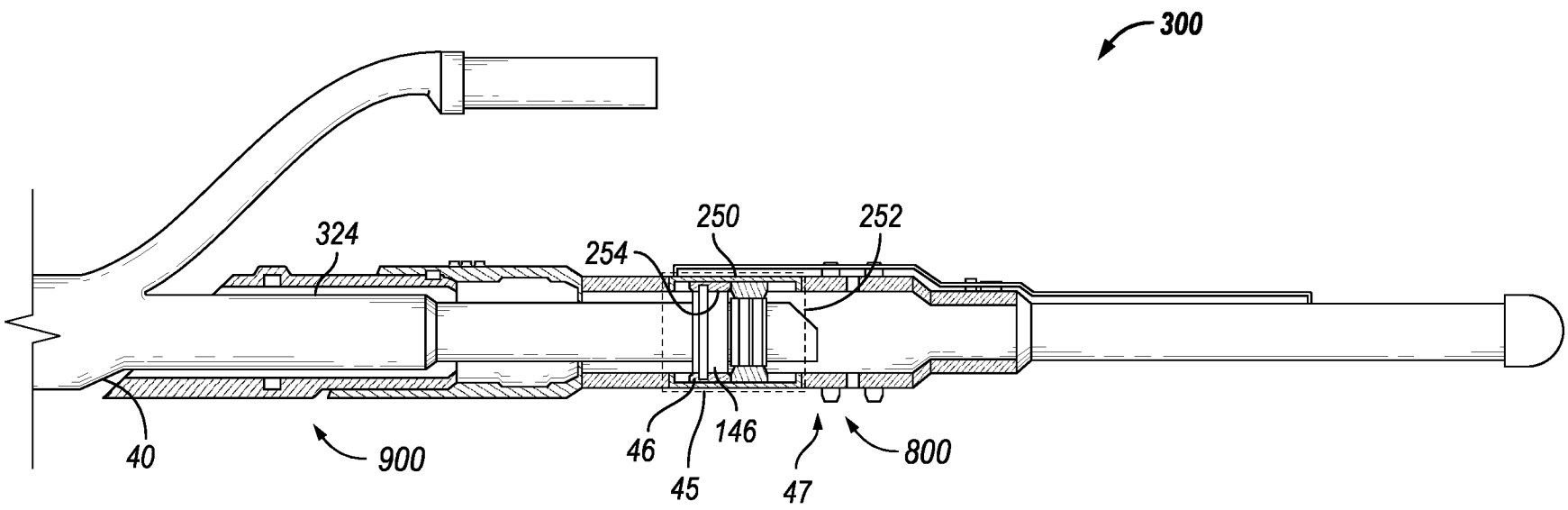
FIG. 9 is a well system with a sliding electrical connector receiving a mainbore leg of a multilateral junction.

FIG. 9 is a well system with a sliding electrical connector receiving a mainbore leg of a multilateral junction. In the illustrated embodiment, the main bore leg 324 of the respective multilateral junction 40 is lowered into the main bore 18 and lands in the multilateral completion deflector 900. The main bore leg 324 extends through the completion deflector 900 to connect with another component 47 (e.g., a lower completion assembly 800). The lower completion assembly 800 may comprise an anchor, an anchor-packer, a seal bore, an ETM 46, a female inductive coupler, a sensor, an energy storage device, a spring, a seal protector device, a collet, a no-go shoulder, a travel joint, a slidable sleeve, a slip joint, a computer, a valve, a meter, control line, a seal assembly, a wet-mate, a pump, screen, a liner, and/or other components used in the production of oil and gas, etc.) attached below the liner hanger. The second downhole tool 120 or components thereof (e.g. multilateral junction 40) may have other devices attached to it including, but not limited to, a seal assembly, a locking device, an ETM 46, a male WETM, a male inductive coupler, a male portion of a downhole wet-mate connector, a sensor, an energy storage device, a spring, a seal protector device, a collet, a no-go shoulder, a travel joint, a slidable sleeve, a slip joint and/or other components used in the production of oil and gas, etc. In some embodiments, these devices may be positioned on the distal end of a mainbore leg 44. In some embodiments, these devices may be positioned below (and/or above) 46 as shown in FIG. 1. In some embodiments, these devices may be positioned below (and/or above) male connector body 170. In some embodiments, these devices may be positioned below (and/or above) the sliding electrical connector 150. Further, as illustrated, the connection 45 may be formed between the main bore leg 324 and the lower completion assembly 800. The connection 45 may comprise an electrical, mechanical, and fluid connection. The electrical connection permits the transmission of electrical power and/or signals across the connection 45. The fluid connection permits the flow of fluids across the connection 45, such as produced hydrocarbons (subject to valves and other flow controls). The mechanical connection may be a releasable connection that physically holds the devices together, to thereby maintain the electrical and fluid connection, until the connection 45 is released. In some embodiments, the mechanical connection allows relative movement between the main bore leg 324 and the well tool to which it is connected (e.g., the deflector 26, the lower completion assembly 800, or other equipment disposed below the liner hanger) while maintaining the electrical and fluid connections.

Accordingly, the present disclosure may provide a sliding connector, system, and method for allowing relative movement between connected downhole tools while staying in electrical contact. The sliding electrical connector may allow axial (e.g., linear) relative movement between connected downhole tools while maintaining fluid and electrical communication between the connected tools. The methods/systems/compositions/tools may include any of the various features disclosed herein, including one or more of the following statements.

Statement 1. A downhole tool connector, comprising: a connector housing defining an axis therethrough; an electrical strip axially arranged along the connector housing; a first connector body moveably secured to the connector housing in sliding electrical contact with the electrical strip over a range of axial displacement between the first connector body and the connector housing; and a second connector body releasably connectable to the first connector body, thereby electrically coupling the second connector body with the electrical strip via the first connector body.

Statement 2. The downhole tool connector of Statement 1, further comprising: a damper operatively coupled to the connector housing to dampen the axial displacement between the first connector body and the connector housing.

Statement 3. The downhole tool connector of Statement 1 or 2, further comprising: a biasing mechanism operatively coupled to the connector housing for biasing the first connector body to a neutral position with respect to the connector housing.

Statement 4. The downhole tool connector of any of Statements 1 to 3, further comprising:

one or more electrical contacts forming the sliding electrical contact with the electrical strip; and one or more conductor wires forming a conductive path from the connector body to the electrical strip to allow relative movement between the first and second connector bodies without flexure of the one or more conductive wires.

Statement 5. The downhole tool connector of any of Statements 1 to 4, wherein the first connector body is electrically connected to a first well tool and the second connector body is electrically connected to a second well tool, wherein the first and second well tools are in electrical communication with each other when the second connector body is releasably secured to the first connector body.

Statement 6. The downhole tool connector of Statement 5, wherein the first and second well tools are in fluid communication with each other when the second connector body is releasably secured to the first connector body.

Statement 7. The downhole tool connector of Statement 5 or 6, wherein one of the first and second well tools is installed downhole and the other of the first and second well tools is removably disposable downhole to releasably couple the first and second well tools via releasably coupling the first and second connector bodies.

Statement 8. The downhole tool connector of any of Statements 1 to 7, wherein the first and second connector bodies comprise an energy transfer mechanism (ETM) configured for electrical communication when the second connector body is releasably secured to the first connector body.

Statement 9. The downhole tool connector of Statement 8, wherein the ETM comprises a wireless energy transfer mechanism (WETM) including an inductive coupler for electrically coupling the first and second connector bodies when the second connector body is releasably secured to the first connector body.

Statement 10. A well system, comprising: a first tool securable to an electrical system downhole and comprising a first connector body; a second tool disposable downhole above the first tool and comprising a second connector body; a connector housing having an electrical strip axially arranged along the connector housing, wherein the first or second connector body is moveably secured to the connector housing in sliding electrical contact with the electrical strip; and wherein the first and second connector bodies are releasably connectable to each other, thereby allowing axial movement between the first and second tools via the connector housing while maintaining electrical communication between the first and second tools.

Statement 11. The well system of Statement 10, further comprising: a damper configured to dampen the axial movement between the first or second connector body and the connector housing that is moveably secured to the connector housing.

Statement 12. The well system of Statement 10 or 11, further comprising: a biasing mechanism operatively coupled to the connector housing for biasing a position of the first or second connector body that is moveably connected to the connector housing.

Statement 13. The well system of any of Statements 10 to 12, wherein the first and second connector bodies comprise an ETM configured for electrical communication when the second connector body is releasably secured to the first connector body.

Statement 14. The well system of any of Statements 10 to 13, wherein the electrical system comprises an intelligent completions system.

Statement 15. The well system of any of Statements 10 to 14, further comprising: a multilateral well system comprising a main bore and a wellbore branch, wherein the first tool is disposed in the main bore or the wellbore branch and the second tool comprises a leg of a multilateral junction configured to connect with the first tool in the main wellbore or the wellbore branch in which the first tool is disposed.

Statement 16. A method of connecting downhole tools, comprising: positioning a first tool downhole in a well; positioning a second tool downhole in the well above the first tool; connecting a first connector body electrically coupled to the first tool with a second connector body electrically coupled to the second tool to establish electrical communication between the first and second tools through the connector first and second connector bodies; and moving the first connector body axially with respect to the first tool while maintaining electrical contact with the first tool, thereby moving the tools relative to one another while maintaining electrical communication between the first and second tools.

Statement 17. The method of Statement 16, further comprising: securing the first tool downhole in the well; and wherein connecting the first connector body to the second connector body comprises lowering the second tool into the well to bring the second connector body into the connection with the first connector body.

Statement 18. The method of Statement 16 or 17, further comprising: performing the step of connecting the first connector body with the second connector body prior to positioning the first and second tools downhole in the well.

Statement 19. The method of any of Statements 16 to 18, wherein moving the first connector body axially with respect to the first tool while maintaining electrical contact with the first tool comprises maintaining sliding electrical contact between a conductive path on the first connector body to an electrical strip axially arranged on a sliding connector housing between the first connector body and the first tool.

Statement 20. The method of any of Statements 16 to 19, further comprising: one or both of damping and biasing the moving of the first connector body axially with respect to the first tool.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole tool connector, comprising:

a connector housing defining an axis therethrough;

an electrical strip axially arranged along the connector housing;

a first connector body moveably secured to the connector housing in sliding electrical contact with the electrical strip over a range of axial displacement between the first connector body and the connector housing, wherein the first connector body is electrically connected to a first well tool and the second connector body is electrically connected to a second well tool;

a second connector body releasably connectable to the first connector body, thereby electrically coupling the second connector body with the electrical strip via the first connector body, wherein the first and second well tools are in electrical communication with each other when the second connector body is releasably secured to the first connector body; and wherein one of the first and second well tools is installed downhole and the other of the first and second well tools is removably disposable downhole to releasably couple the first and second well tools via releasably coupling the first and second connector bodies.

2. The downhole tool connector of claim 1, further comprising:

a damper operatively coupled to the connector housing to dampen the axial displacement between the first connector body and the connector housing.

3. The downhole tool connector of claim 1, further comprising:

a biasing mechanism operatively coupled to the connector housing for biasing the first connector body to a neutral position with respect to the connector housing.

4. The downhole tool connector of claim 1, further comprising:

one or more electrical contacts forming the sliding electrical contact with the electrical strip; and one or more conductor wires forming a conductive path from the connector body to the electrical strip to allow relative movement between the first and second connector bodies without flexure of the one or more conductive wires.

5. The downhole tool connector of claim 1, wherein the first and second well tools are in fluid communication with each other when the second connector body is releasably secured to the first connector body.

6. The downhole tool connector of claim 1, wherein the first and second connector bodies comprise an energy transfer mechanism (ETM) configured for electrical communication when the second connector body is releasably secured to the first connector body.

7. The downhole tool connector of claim 6, wherein the ETM comprises a wireless energy transfer mechanism (WETM) including an inductive coupler for electrically coupling the first and second connector bodies when the second connector body is releasably secured to the first connector body.

8. A well system, comprising:

a first tool securable to an electrical system downhole and comprising a first connector body;

a second tool disposable downhole above the first tool and comprising a second connector body;

a connector housing having an electrical strip axially arranged along the connector housing, wherein the first or second connector body is moveably secured to the connector housing in sliding electrical contact with the electrical strip; and wherein the first and second connector bodies are releasably connectable to each other, thereby allowing axial movement between the first and second tools via the connector housing while maintaining electrical communication between the first and second tools.

9. The well system of claim 8, further comprising:

a damper configured to dampen the axial movement between the first or second connector body and the connector housing that is moveably secured to the connector housing.

10. The well system of claim 8, further comprising:

a biasing mechanism operatively coupled to the connector housing for biasing a position of the first or second connector body that is moveably connected to the connector housing.

11. The well system of claim 8, wherein the first and second connector bodies comprise an energy transfer mechanism (ETM) configured for electrical communication when the second connector body is releasably secured to the first connector body.

12. The well system of claim 8, wherein the electrical system comprises an intelligent completions system.

13. The well system of claim 8, further comprising:

a multilateral well system comprising a main bore and a wellbore branch, wherein the first tool is disposed in the main bore or the wellbore branch and the second tool comprises a leg of a multilateral junction configured to connect with the first tool in the main wellbore or the wellbore branch in which the first tool is disposed.

14. A method of connecting downhole tools, comprising:

positioning a first tool downhole in a well;

positioning a second tool downhole in the well above the first tool;

connecting a first connector body electrically coupled to the first tool with a second connector body electrically coupled to the second tool to establish electrical communication between the first and second tools through the connector first and second connector bodies; and moving the first connector body axially with respect to the first tool while maintaining electrical contact with the first tool, thereby moving the tools relative to one another while maintaining electrical communication between the first and second tools.

15. The method of claim 14, further comprising:

securing the first tool downhole in the well; and wherein connecting the first connector body to the second connector body comprises lowering the second tool into the well to bring the second connector body into the connection with the first connector body.

16. The method of claim 14, further comprising:

performing the step of connecting the first connector body with the second connector body prior to positioning the first and second tools downhole in the well.

17. The method of claim 14, wherein moving the first connector body axially with respect to the first tool while maintaining electrical contact with the first tool comprises maintaining sliding electrical contact between a conductive path on the first connector body to an electrical strip axially arranged on a sliding connector housing between the first connector body and the first tool.

18. The method of claim 14, further comprising:

one or both of damping and biasing the moving of the first connector body axially with respect to the first tool.

* * * * *